United States Patent [19]

Parker

[11] Patent Number: 4,905,278

[45] Date of Patent: Feb. 27, 1990

[54] SCRAMBLING OF ANALOGUE ELECTRICAL SIGNALS

[75] Inventor: Michael A. Parker, London, United Kingdom

[73] Assignee: British Broadcasting Corporation, London, United Kingdom

[21] Appl. No.: 221,901

[22] Filed: Jul. 20, 1988

[30] Foreign Application Priority Data

Jul. 20, 1987 [GB] United Kingdom ..... 8717066

[51] Int. Cl.[4] ..... H04K 1/04

[52] U.S. Cl. ..... 380/7; 380/8; 380/19; 380/36; 380/46

[58] Field of Search ..... 380/19, 36, 46, 6–8

[56] References Cited

U.S. PATENT DOCUMENTS

| | | | |
|---|---|---|---|
| 3,921,151 | 11/1975 | Guanella | 380/36 |
| 4,433,211 | 2/1984 | McCalmont et al. | 380/36 |
| 4,443,660 | 4/1984 | DeLong | 380/46 |
| 4,547,802 | 10/1985 | Fogarty et al. | 380/19 |
| 4,551,580 | 11/1985 | Cox et al. | 380/46 |
| 4,600,941 | 7/1986 | Sakamoto et al. | 380/19 |
| 4,646,147 | 2/1987 | Kruger | 380/19 |
| 4,659,875 | 4/1987 | Taurin et al. | 380/19 |
| 4,683,586 | 7/1987 | Sakamoto et al. | 380/19 |
| 4,731,839 | 3/1988 | Goray et al. | 380/19 |

FOREIGN PATENT DOCUMENTS

| | | |
|---|---|---|
| 0112158 | 6/1984 | European Pat. Off. . |
| WO83/01717 | 5/1983 | PCT Int'l Appl. . |
| WO84/00656 | 2/1984 | PCT Int'l Appl. . |

*Primary Examiner*—Salvatore Cangialosi
*Attorney, Agent, or Firm*—Robert F. O'Connell

[57] ABSTRACT

In a system in which an audio signal is scrambled by being divided into blocks each comprising a plurality of segments, and the segments are re-ordered within the blocks to provide the scrambled signal, the joins between the segments are required to be located at a descrambler. To enable the joins to be located, a framing sequence is added to the signal in synchronism with the segments and which consists of a low-level signal having a frequency spectrum which is substantially similar to the spectrum of the audio signal. Preferably a pseudo-random binary sequence is used having typically 200 to 500 bit periods per segment.

7 Claims, 5 Drawing Sheets

SCRAMBLING OF ANALOGUE ELECTRICAL SIGNALS

BACKGROUND OF THE INVENTION

The invention relates to a method and an apparatus for scrambling an analogue electrical input having a certain frequency spectrum in which the signal is divided into segments and the segments re-ordered to form a re-ordered signal.

The invention will be described in the context of scrambling analogue sound signals forming part of a television signal such as in Pay Television or other so-called conditional-access television signals. The invention is particularly suitable for television signals which are recorded on a video tape recorder (or video cassette recorder—VCR) for subsequent replay. In one method of scrambling such analogue sound signals the sound signal is divided into short segments each of a fraction of a second long. The segments are grouped into blocks with a predetermined number of segments forming each block, typically four or more.

Such a signal can then be scrambled by re-ordering the segments within each block. To control the re-ordering a pseudo-random or chain code sequence can be used. This sequence has to be synchronised at the receiver with the transmitter sequence, such as by using an enciphered and dicephered code word. At the descrambler the scrambled segments are put back into the correct order to form the descrambled output sound signal.

DESCRIPTION OF THE PRIOR ART

In such a system a problem arises of how to mark and hence accurately locate the joints between the different segments. One known system proposes the use of a burst of about six cycles of a sine-wave between segments. However, this has the disadvantage of requiring special compression circuits at the scrambler and expansion circuits at the descrambler to make room for the marker burst. Furthermore, the marker burst may also be helpful to a pirate trying to descramble the signal illegally.

Another known system, described in European Patent Application No. 0112158, locates the joints between segments by the insertion of a control signal in a redundant portion of the waveform between the end of one segment and the beginning of the next. The redundant portion is produced by time-compressing the waveform. The control signal thus acts as a time marker in the same way as the synchronising pulse in a television waveform.

It will be appreciated that a sound signal will on average, over a period of time, have a substantially uniform spectrum over the frequency range transmitted, which may typically be approximated to the range 100 Hz to 3 kHz.

SUMMARY OF THE INVENTION

In a first aspect the invention provides a method of scrambling an analogue electrical input signal having a certain frequency spectrum. The signal is divided into segments and said segments are re-ordered to form a re-ordered signal. A defined binary sequence having a frequency spectrum substantially similar to the said spectrum of said analogue electrical input signal is added to the re-ordered signal in synchronism with the segments.

In a preferred embodiment of the invention a television sound signal is in analogue form and constitutes part of a conditional-access television signal. The signal is formed into segments, each typically 80ms long, with each group of four segments constituting a block. The signal is scrambled by re-ordering the blocks in an essentially random order as controlled by a pseudo-random sequence generator.

Preferably, the joins between segments are identified by superimposing on the re-ordered signal a low-amplitude binary sequence, with a spectrum that is roughly uniform between the lower and upper parts of the sound spectrum, say from 100 Hz up to 3 kHz. That is to say the spectrum of the added binary sequence approximates (apart from overall amplitude) to that of the input audio signal.

Typically an essentially random signal will achieve this function with normal broadcast material. In particular, a pseudo-random binary sequence can be used as the added signal. One complete cycle of this sequence could, for example, correspond to the length of one segment. At the descrambler a correlator checks for this sequence and having decoded the correct phase of the sequence, the position of the joins between segments can be found. A signal having the waveform of a regenerated version of the same sequence is then subtracted from the scrambled signal so as to reduce the level of interference from the added sequence to the descrambled output signal.

There are many different ways in which a binary sequence with the desired spectral characteristics can be generated. To increase the security of the system the sequence can be varied during transmission using a special key or part of the main decoding key. For example, a sequence with a bit rate of 2.5 kbit/s can be used, and if the segment length is 80 ms this gives 200 bit periods for each segment. In a further aspect, the invention provides a method of descrambling an analogue electrical input signal scrambled by the method described above, comprising detecting the binary sequence added to said signal to define the segments in the signal, and reordering said segments in synchronism with the detected binary signal. While the use of pseudo-random sequences as time markers is described in relation to analogue audio signals it will be appreciated that the system is also applicable to other analogue signals.

BRIEF DESCRIPTION OF THE DRAWINGS

The invention will now be described in more detail by way of example with reference to the accompanying drawings, in which.

DETAILED DESCRIPTION OF A PREFERRED EMBODIMENT

The scrambling system to be described involves re-ordering segments of sound data in time. This is shown diagrammatically in FIG. 1. At the coder or scrambler 10, the continuous input sound signal is first divided up into blocks, and each block is further divided into four segments of equal length. Scrambling is achieved by re-ordering these segments within their respective blocks. There are for example 24 possible arrangements of four segments within a block, the arrangement for a particular block being determined by a pseudo-random sequence. At the descrambler 20, an identical sequence generator, correctly phased to the incoming block structure, is needed to re-assemble the segments in the original order. This generator is synchronised with the transmitted sequence using encrypted digital codes included in the video data which are decrypted using the conditional access key.

In order to assess this method of sound scrambling the functions of the scrambler and descrambler were performed in non-real time by an experimental microcomputer based system. The sampling frequency was 32 kHz, with 16 kits per sample. Sound files were processed by a program written to perform the functions of the scrambler. The resulting file of scrambled sound was replayed from disc via a DAC (digital to analogue converter) and recorded on the sound track of a VCR 30. The replayed signal from the VCR was then re-recorded on disc. A second program, written to perform the functions of the descrambler, was used to process this data to produce a file of continuous sound samples which could then be reproduced via a DAC and loudspeaker.

Scrambler

Figure 2:
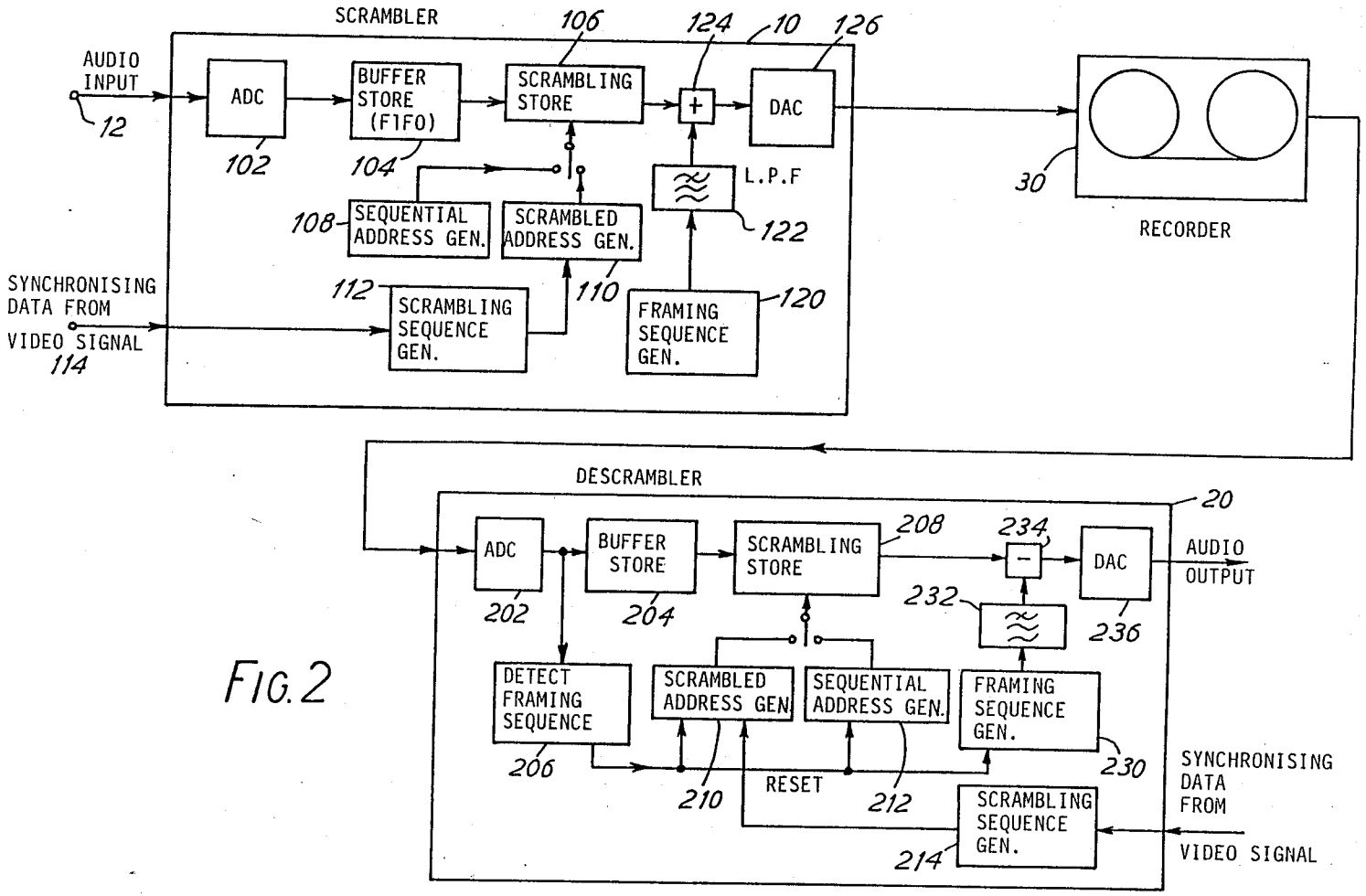
FIG. 2 is a schematic block diagram illustrating a sound scrambler and descrambler.

FIG. 2 shows a schematic block diagram illustrating the various functional blocks of the scrambler.

The signal at the input 12 is taken to a store 106 via an analogue to digital converter 102 and a buffer 104 which holds 1 block of sound data. In the experimental system this comprised 8192 samples and corresponded to about ¼ second of sound. This represents a reasonable comprise between opacity, which increases with increased block length, and transmission delay (equal to twice the block length). The store is filled using a sequential address generator 108 to control the wiring operation. When full, the contents of the store are read using an addressing pattern determined by the required scrambled segment-order for that block. This is supplied by a scrambler address generator 110. In a fully implemented system the scrambled segment order could be changed from block to block under the control of a pseudo-random sequence. Thus the scrambled address generator 110 is controlled by a scrambling sequence generator 112 which receives synchronising data from the video signal 114. In the experimental system, however, a fixed scrambled segment order was used to simplify the descrambling operation.

Before the signal can be descrambled on replay from the VCR 30, the precise position of the boundaries between segments must be found. Timing information from the video signal cannot be used for this purpsoe, because the relative timing jitter between the replayed video an sound signals is too great. Timing information in the form of a framing signal must therefore be carried with the sound signal itself.

Framing Sequence

In the experimental system, in accordance with this invention, the framing signal consisted of a repeated binary sequence added to the scrambled audio waveform at a low level (about −30dB). The framing sequence (FS) is chosen to have a frequency spectrum which is substantially similar to that of the analogue sound signal being simulated. The framing sequence was detected at the receiver using a correlation process. This framing technique gives an additional element of security to the system since the framing sequence must be known before the signal can be descrambled.

Figure 3:
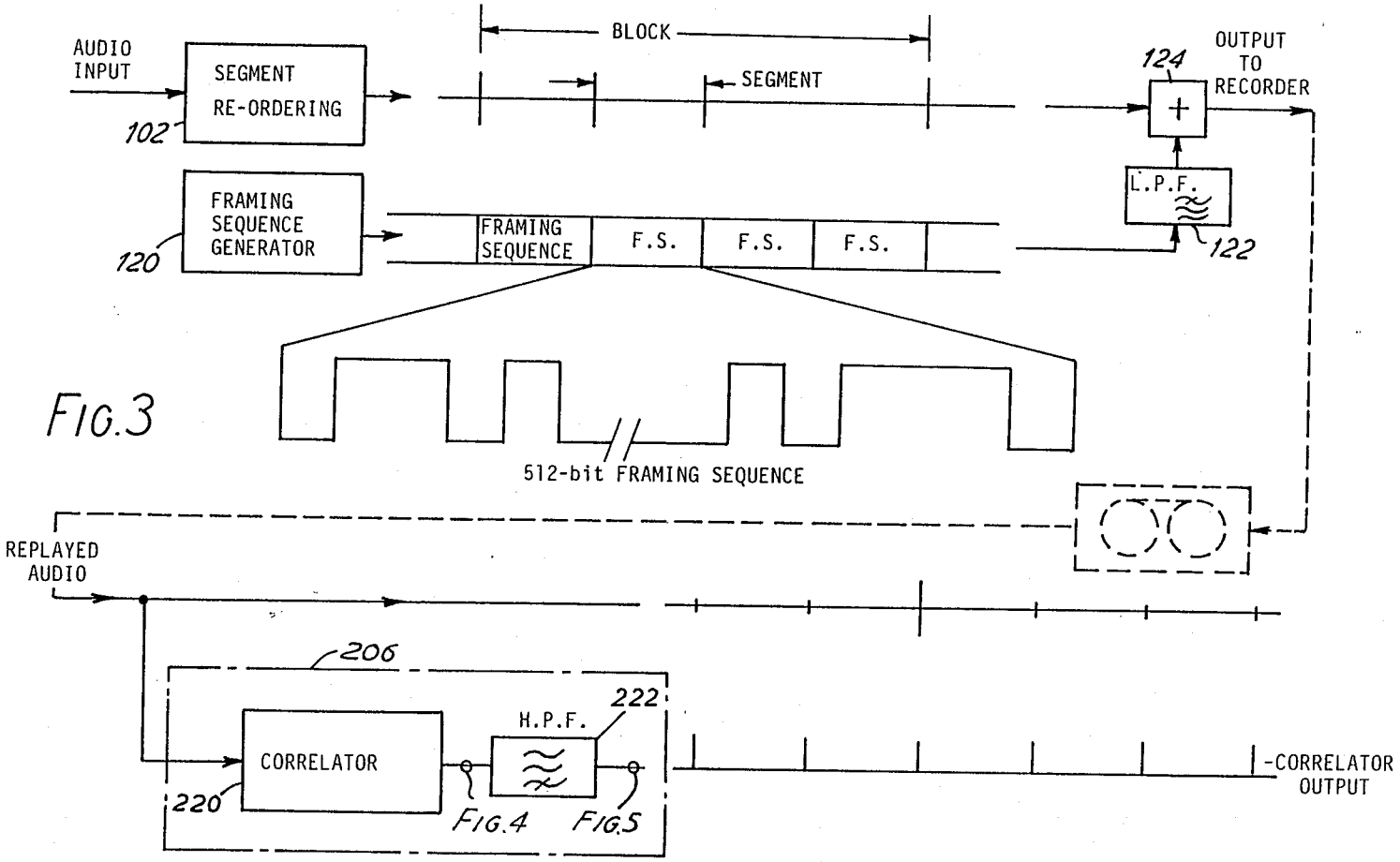
FIG. 3 is a schematic diagram illustrating the synchronisation of a segment re-ordering scrambling system in accordance with this invention.

A block diagram of this system is shown in FIG. 3. The sequence consists of a 511-bit PRBS (pseudo-randon binary sequence) with an extra bit added to give a 512-bit sequence with no dc content. A PRBS has the desirable characteristic of an autocorrelation function which is close to zero for all out-of-phase values, with a narrow (one bit-cell wide) in-phase peak and a frequency spectrum which is noise-like: noise-like signals are those to which the ear is least sensitive and those which might best be masked by typical program material.

The framing sequence was read from a framing sequence generator 122 in the form of a store as an 8 kbit/s serial bit stream with a fixed phase relationship with respect to the scrambled sound segments. During recording and replay, components in this signal above 8 kHz would probably be affected by the response limitations of the recorder so these components were removed by a low-pass filter 122. The filtered framing sequence was then added to the scrambled audio signal on an adder 124 and passed through a digital to analogue converter 126 to produce the final output for recording. To ensure reliable detection of the sequence under conditions of varying programme level, the level of the sequence was varied according to the mean programme level. This also reduced any interference from the framing signal during quiet passages.

After recording and replay form the VCR 30, a correlator in the decoder was used to find the "phase" of this sequence with respect to the replayed sound data. Once found, the positions of the boundaries between segments were known and the signal could be decoded.

The factors to be considered in the choice of the added framing or marker signal include the following:

(a) The added signal has to carry the segment phasing information, and thus requires a reasonable mixture of high and low frequencies. For example, if a sine wave were used with its period equal to the segment length, this would allow the rough position of the segment to be identified, but the exact position would be difficult to determine in the presence of the wanted signal and noise. If a sine wave at a higher multiple of the segment frequency were used, then there would be an ambiguity between the individual cycles. As the psuedo-random sequence has a flat spectrum, the requirement for a range of frequencies is fulfilled by the use of such a sequence.

(b) Preferably the added signal should be reasonably imperceptible, in case the subsequent suppression process is imperfect. The noise-like properties of the psuedo-random sequence are particularly suitable in this respect.

(c) It is an advantage if the signal is easy to generate. Pseudo-random sequence generation is straightforward.

(d) Precise time marking requires a waveform with abrupt transitions, which generate an unlimited range of frequency components. In the context of band-limited signal channels, however, such signals are bound to be distorted, losing their highest frequency components. As the gain and phase performance near the band edge is often poorly defined, it is preferable to limit the spectrum of the marker signal in a defined manner before it is added to the wanted signal. Although this reduces the fundamental accuracy of the timing information, the marker signal can pass through the channel substantially without distortion and be cancelled accurately by a marker signal filtered in the same predefined manner.

(e) In a tape recording, poor timing stability in the replayed signal may lead to variations of phase even within the duration of a segment. Under these circumstances, a marker waveform that contains a large number of transitions, such as a psuedo-random sequence, is preferable to those that do not, such as a segment frequency squarewave or an impulse, which are unable to show the higher frequency components of the timing variation.

From these viewpoints the pseudo-random signal is very suitable, but other signals with reasonably similar properties could be used.

Descrambler

Figure 1:
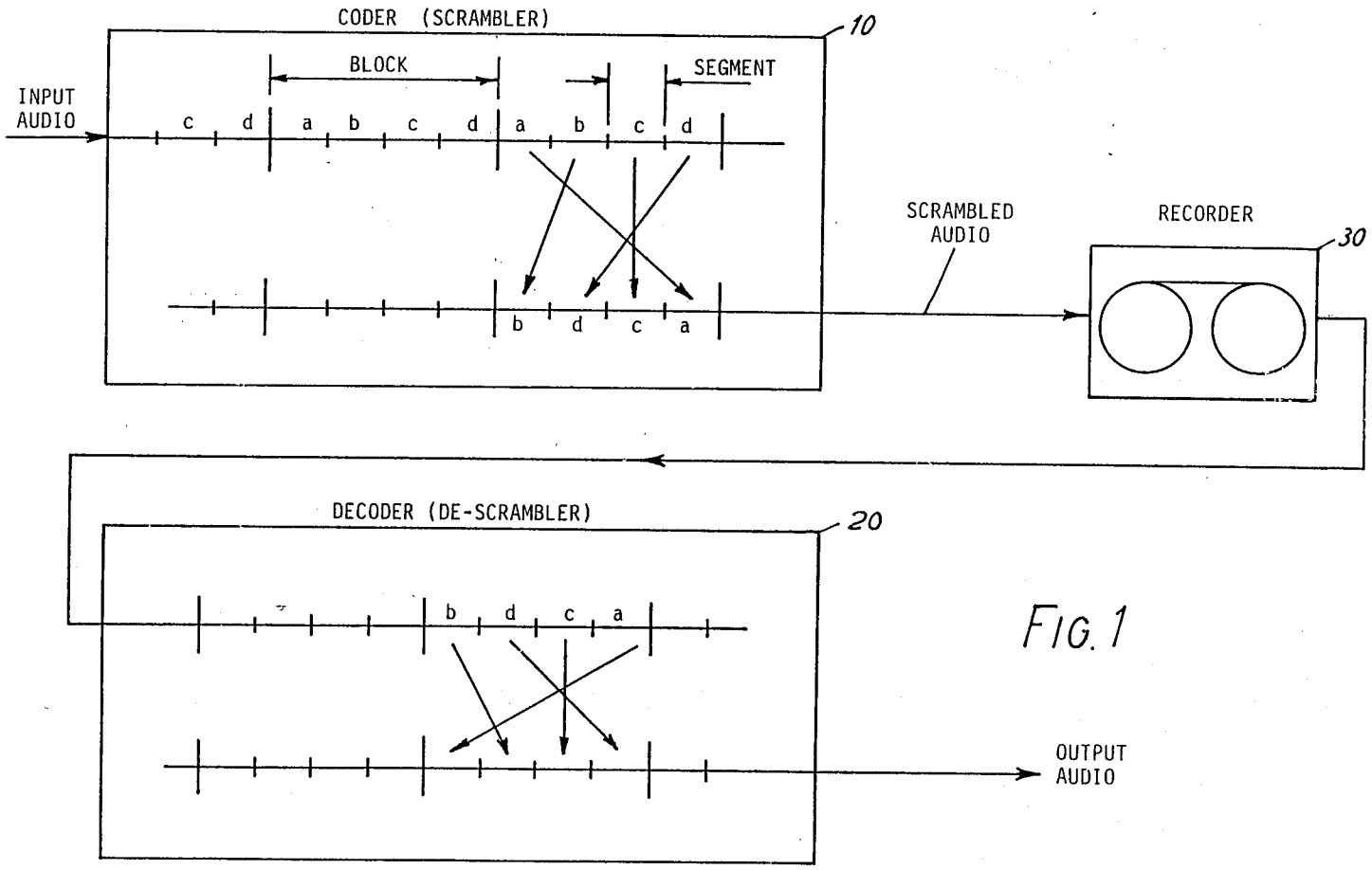
FIG. 1 is a diagram illustrating the principles of sound scrambling by segment re-ordering.

The descrambling operation is similar to scrambling (FIG. 1). The analogue sound signal, replayed from the VCR 30, is divided into the original segments which are then re-ordered under the control of a locally generated pseudo-random sequence to produce the original sound signal. This sequence generator is initialised by data included in the video signal.

For this purpose the descrambler 20 includes an alanogue to digital converter 202 connected to the descrambler input and a buffer store 204 and a framing sequence detector circuit 206 both connected to the ADC output. A store 208 reverses the operation of the store 106 at the scrambler and receives the signal from the buffer store 204. Writing is controlled by a scrambled address generator 210 and reading by a sequential address generator 212. The scrambled address generator is controlled by a scrambling sequence generator 214 which receives synchronising data from the video signal. Both address generators are reset by the framing sequence detector.

Figure 4:
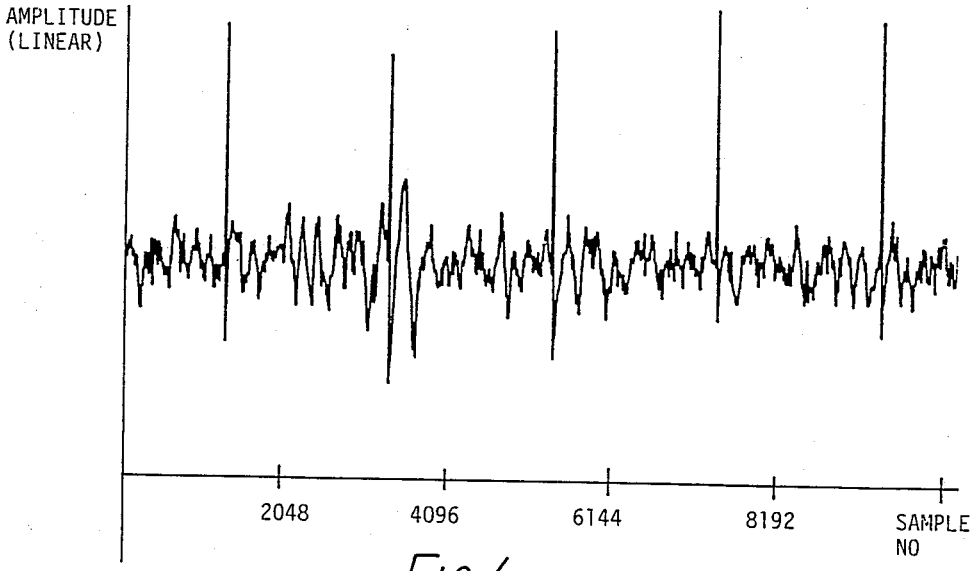
FIG. 4 is an illustration of the correlator output waveform before filtering.
Figure 5:
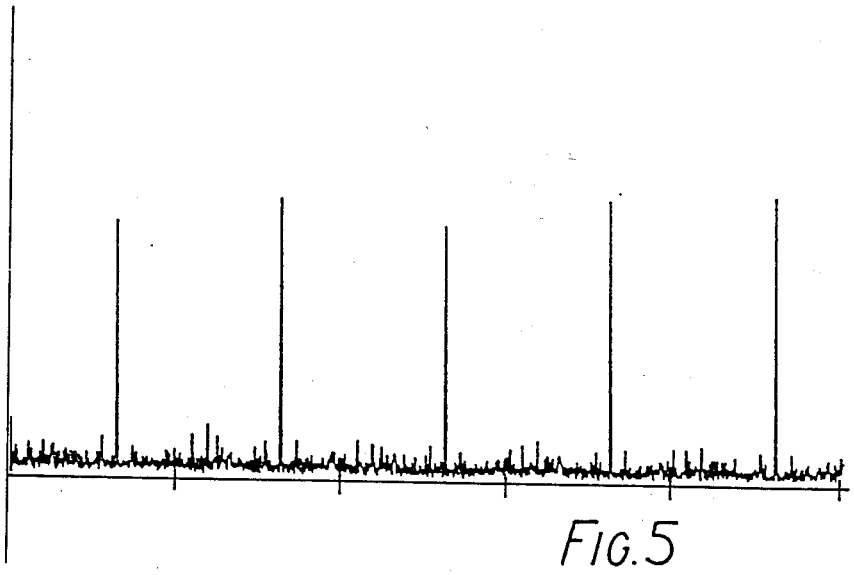
FIG. 5 is a corresponding illustration showning the waveform after filtering.
Figure 6:
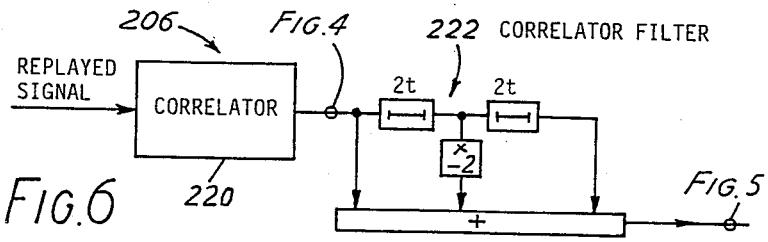
FIG. 6 is a block circuit diagram of the correlator filter.

Before the signal can be descrambled, the positions of the boundaries between segments must be found. This is achieved in a correlator 220 by correlating the incoming signal with a locally generated framing sequence for all 512 possible phases of the sequence. Since the relative bit-phase of the transmitted and locally generated sequences is not defined, each phase of the sequence is tested in four possible bit-phases. This involves performing the correlation for each sample-phase of the incoming data since each bit of the framing sequence is equivalent to four sample periods. This also increases the timing accuacy of the system to 1 sample. The output from the correlator is then taken to a high-pass transversal filter to remove the low-frequency correlation component between the signal and the sequence. FIG. 4 shows the output from the correlator before filtering and FIG. 5 shows the output after filtering. The filter is shown in FIG. 6, and consists of two 2-sample delays 224 in cascade, amultiplier 226 connected to the centre junction between the delays, and an adder 228 connected to add the delay input and output signals and the multiplier output. The maximum output value from the filter is found for the 2048 different sample phases, equivalent to one segment length. The phase at which this occurs is stored and compared with the phase derived for the following segments. When three phase values within 4 samples have occurred consecutively the system changes to its "in lock" mode. Having found the phase of the sequence with respect to segment boundaries,the position of the segment boundaries is known and the signal can be descrambled.

After reordering, the framing sequence is removed. A framing sequence generator 230, synchronised by the framing sequence detector 206 supplies the sequence which is filtered by filter 232 similar to filter 122 at the scrambler and subtracted from the video signal in a subtractor 234. The subtractor output is applied to a digital to analogue converter 236.

Once the system is in lock, the correlator need not check for all possible phases of the framing sequence. Allowance must be made only for the timing instability of the medium. Typically for the analogue track of a VCR this is about 4 samples from segment to segment. To allow for the operation of the correlator filter, the correlation was carried out between −7 and +7 samples of the sample-phase found previously.

Figure 7:
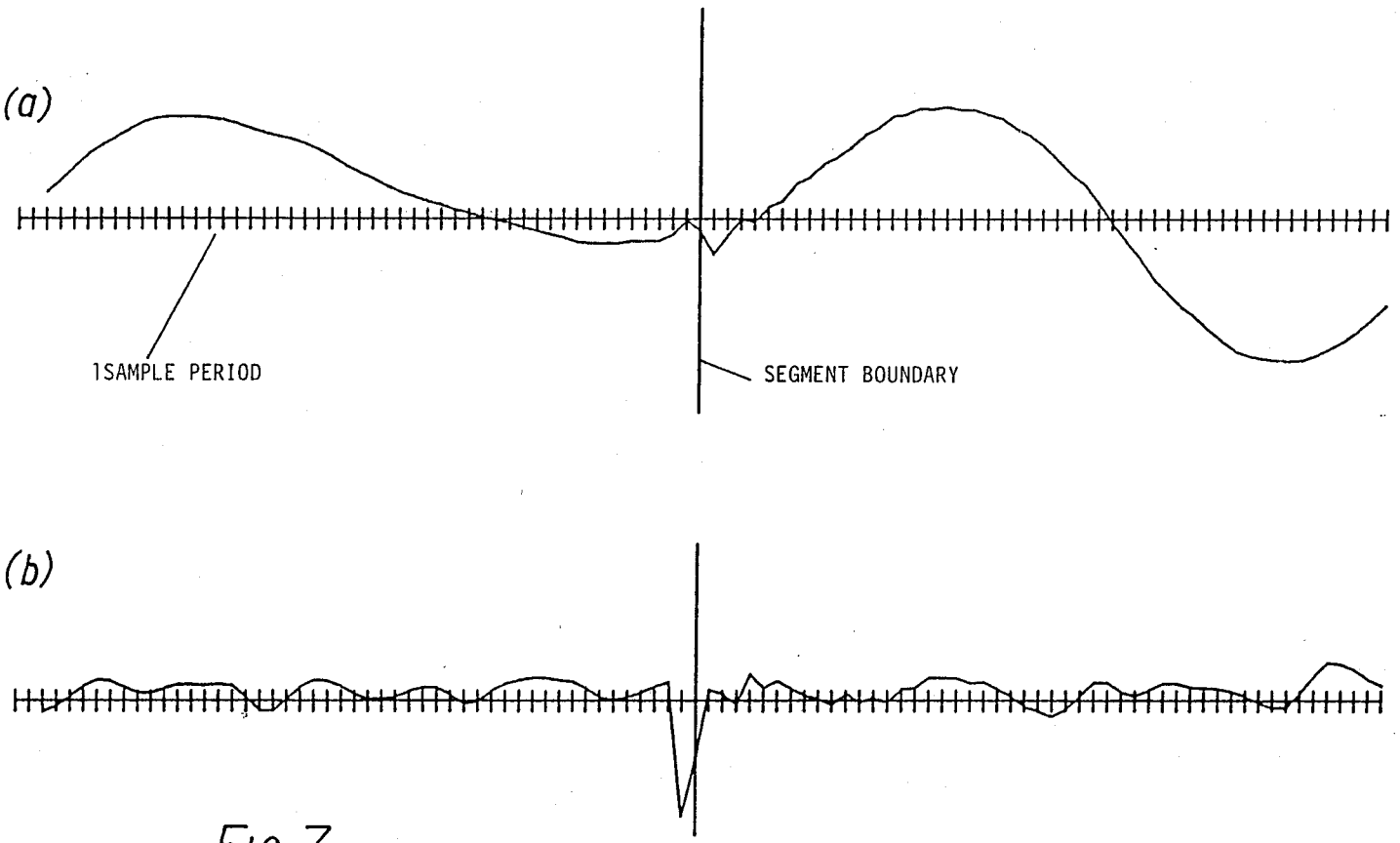
FIG. 7 illustrates two discontinuities at segment boundaries in the descrambled signal.

The irregular delay and amplitude frequency responses of the recorder had the effect of mixing information between adjacent systems. After descrambling, this produced discontinuities at segment boundaries, which were audible as "clicks". These were caused predominantly by the band-edge effects of the recorder. The high-frequency roll-off has the effect of spreading information up to about 2 samples either side of the segment boundaries. The low-frequency effects were more severe and affected about 200 samples. FIG. 7 shows an example of these two types of discontinuity, namely at (a) a discontinuity caused by low-frequency interference between segments and at (b) a discontinuity caused by high-frequency interference between segments. To mask these impairments, an interpolator was devised which modified the descrambled sample values close to the segment boundaries. First the low-frequency discontinuity between segments was measured to derive a correction signal that was added to the end of each segment to match it to the beginning of the next. A linear interpolation was then performed between points within 2 samples of the segment boundary to remove any high-frequency discontinuities. This process was effective in removing the high-frequency component of the discontinuity. Low frequency effects were still audible, however, on cricital material. It was found these low-frequency effects could be reduced further by high-pass filtering the sound signal before scrambling.

The system was tested with a conventional longitudinal VCR sound rack and with a "HI-FI" sound machine. In the HI-FI machine, the sound is recorded as an FM signal via the normal rotary video head. This system has a superior noise performance to that of the normal sound track with the consequence that, with certain programme material, the framing sequence could be heard in the replayed signal. To reduce this effect, a regenerated version of the framing sequence was subtracted from the output signal.

The system was effective in rendering speech unintelligible, though it was not sufficiently opaque to disguise the sex of the speaker or that English was the language spoken. With music, the system was less opaque because of the slower changes in the sound content. A longer segment length should increase the opacity for music signals. Although the interpolation process significantly reduced the level of disturbance at the segment boundaries, effects were still audible on critical material. These were more disturbing with the HI-FI machine because of the absence of oher impairments.

What I claim is:

1. A method of scrambling an analogue electrical input signal having a certain frequency spectrum in which:

said signal is divided into segments;

said segments are re-ordered to form a re-ordered signal; and a defined binary sequence having a frequency spectrum substantially similar to the said spectrum of said analogue electrical input signal is added to the re-ordered signal in synchronism with the segments.

2. The invention set forth in claim 1, wherein said defined binary sequence is a pseudo-random binary sequence.

3. The invention set forth in claim 1, wherein said analogue signal comprises an audio signal.

4. A method of descrambling an analogue electrical input signal scrambled by the method of claim 1, comprising the steps of:

detecting the binary sequence added to said signal to define the segments in the signal; and reordering said segments in syunchronism with the detected binary signal.

5. The invention set forth in claim 4, wherein said analogue signal comprises an audio signal.

6. Apparatus for scrambling an analogue electrical input signal having a certain frequency spectrum, the apparatus including;

means for dividing said analogue electrical input signal into segments;

means for re-ordering said segments to form a re-ordered signal; and means for adding to said re-ordered signal a defined binary sequence having a frequency spectrum substantially similar ot the said spectrum of said input signal in synchronism with the segments.

7. Apparatus for descrambling an electrical analogue signal scrambled using the apparatus of claim 6, the apparatus comprising:

means for detecting a binary sequence added to said scrambled analogue signal to define segments in the signal; and means for re-ordering the segments in synchronism with said detected binary signal.

* * * * *